United States Patent [19]

Patton et al.

[11] 4,192,181

[45] Mar. 11, 1980

[54] CASING ASSEMBLY PROBES

[75] Inventors: Franklin D. Patton, West Vancouver; James D. McFarlane, Vancouver, both of Canada

[73] Assignee: Westbay Instruments Ltd., West Vancouver, Canada

[21] Appl. No.: 959,915

[22] Filed: Nov. 13, 1978

[51] Int. Cl.[2] ..... E21B 49/00

[52] U.S. Cl. ..... 73/155

[58] Field of Search ..... 73/155, 151, 422 R, 73/152; 166/69, 166, 169, 264

[56] References Cited

U.S. PATENT DOCUMENTS

| | | | |
|---|---|---|---|
| 3,323,361 | 6/1967 | Lebourg | 73/155 |
| 3,677,080 | 7/1972 | Hallmark | 73/155 |

*Primary Examiner*—Jerry W. Myracle

*Attorney, Agent, or Firm*—Fulwider, Patton, Rieber, Lee & Utecht

[57] ABSTRACT

A probe or instrument to be moved through casing assemblies having ports therein at different levels selectively to take samples and/or measurements at these levels. The probe is an elongate body which is lowered through the casing assembly by a suitable cable. A stop on the body cooperates with a stop in the casing assembly at each level to position a port in the body in registry with a port in the casing at this level. A seal on the body is pressed against the adjacent casing assembly wall to isolate the registering ports from the interior of the casing at this time.

13 Claims, 9 Drawing Figures

CASING ASSEMBLY PROBES

FIELD OF THE INVENTION

This invention relates to probes movable longitudinally through casing assemblies for taking samples from and/or measurements of conditions at the exterior of said casing assemblies at different levels without the samples or measurements being contaminated by conditions in the interior of the assemblies or at other levels on the exterior thereof.

DESCRIPTION OF THE PRIOR ART

Casings or casing assemblies have been placed in well or drill holes in the past for taking inclinometer or piezometric measurements. It has not been practical to take inclinometer measurements and piezometric measurements in the same casing.

It is common for one or two piezometeric (fluid or gas pressure) measurements to be made in a single well and occasionally as many as four different locations have been monitored in a single well. However, in these cases separate casings or individual hydraulic or pneumatic tubing are required to each location or level where measurements are to be taken. There is a practical limit of about three or four installations that can be successfully placed in a single well. Electrical or electronic devices for taking piezometer measurements have not been overly successful or accurate.

Probes or instruments have been used for taking measurements in casings located in a bore or drill hole or in bodies of water, but it has been difficult to locate these probes or instruments exactly where the measurements are to be taken. Accuracy is important if several samples or measurements are to be taken at a given level for comparison and other purposes. As a result of this problem, it has not been in the past practical to take accurate samples or measurements precisely at a number of different levels.

SUMMARY OF THE INVENTION

A probe or instrument in accordance with the present invention includes means for co-operating with a casing assembly at each of a plurality of different levels thereof for the taking one or more of samples from or measurements on the exterior of the casing assembly at each level without contamination by the conditions in the interior of the casing assembly or at the other levels on the exterior of said assembly. Although these probes are primarily designed to take samples or measurements at the different levels, it is to be understood that they can be used to eject fluid into the environment surrounding the casing assembly at the different levels. For example tracer fluids can be ejected at selected levels into the ground in order to check the flow of fluids in the ground.

Each probe of this invention basically includes the means for locating or stopping the probe in an exact position at each desired level in a casing assembly, and means for ensuring that the samples or measurements, such as temperature or pressure measurements taken outside the assembly, are not contaminated by conditions inside the assembly or at the other levels on the exterior thereof. The probe also includes means for opening a valve in the casing assembly in which the probe is operating at each measuring level. The probe can be constructed to take samples and different measurements at each level. For example, the probe can be quite simple and designed to take one or more liquid or gas samples, or it may be more complex and take one or more desired measurements, such as temperature, pressure, pH, eH, salinity, conductivity, dissolved oxygen content, radioactivity, and the like measurements.

A probe in accordance with the present invention for use in casing assemblies which include casings, couplings and packers, and having ports therein at different levels through which samples and/or measurements can be taken from the environment around the casing assemblies at said ports, comprises an elongate body having an upper end to be connected to suspension means through which fluids and data operating power can flow to and from the body, a port in the body, stop means on the body to co-operate with stop means on the casing assembly in which the probe operates at each level to stop the probe with the body port in registry with the casing port at said each level, and sealing means at the body port to isolate said body port from the interior of the casing assembly when the body port is in registry with a casing assembly port, whereby samples and/or measurements can be selectively taken from outside the casing assembly and through the registering ports without contamination or interference by conditions within the assembly at any other of said casing assembly ports.

More specifically, a probe of this invention comprises an elongate body having an upper end to be connected to suspension means through which fluids and data operating power can flow to and from the body, a port in the body, sealing means around said port, a locating arm swingably mounted near an end in the body, said arm being swingable between an inner position in the body and an outer position projecting outwardly and downwardly of the body, a latch normally retaining the arm in the inner position, spring means to bias the arm outwardly when said arm is released, a shoe mounted on the body of the side thereof opposite the body port for movement outwardly and inwardly relative to the body, means normally biasing the shoe inwardly relative to the body, means connecting the latch to the shoe to cause the latch means to move with the shoe and thereby release the locating arm, and power means selectively operable to move the shoe outwardly of the body, whereby a first operation of the power means causes movement of the shoe to release the locating arm to engage a stop on the casing so positioned as to stop the probe with the port thereof in registry with an adjacent port of the casing assembly, and a second operation of the power means moves the shoe outwardly of the probe body and against the casing assembly to press the sealing means against the casing assembly around the port thereof to isolate said port from the interior of the casing assembly.

BRIEF DESCRIPTION OF DRAWINGS

Examples of this invention are illustrated in the accompanying drawings in which.

DESCRIPTION OF PREFERRED EMBODIMENTS

Figure 1:
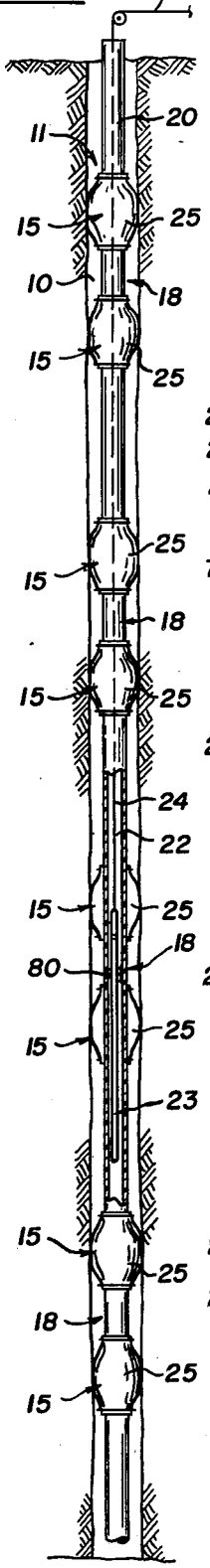
FIG. 1 diagrammatically illustrates a well or bore hole having a casing assembly therein with a probe positioned at one level, FIG. 2 diagrammatically illustrates a portion of the casing assembly including packers fitting tightly within the bore hole or well and interconnected by couplers located at different levels where measurements are to be taken.
Figure 2:
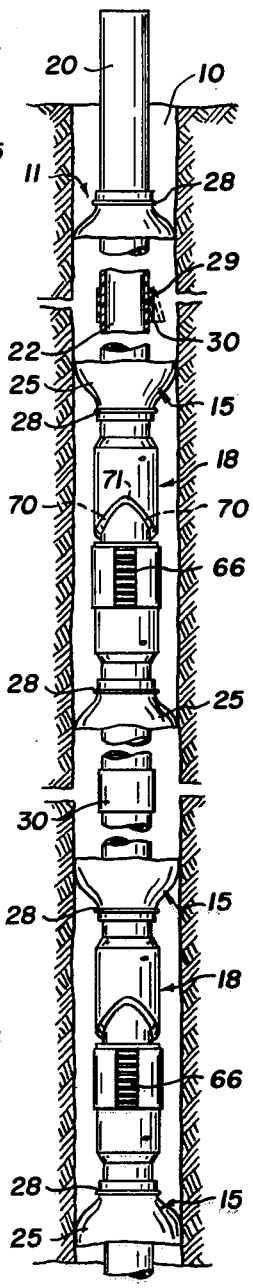

Referring to FIGS. 1 and 2, 10 is a well or bore hole, and 11 is a casing assembly, such as a geological and geophysical casing assembly, made up of a plurality of packers 15 interconnected by suitable lengths of tubing or casing such as couplers 18. The packers 15 include elongate casings 20 which are interconnected at adjacent ends by these couplers to form a passageway 22 extending longitudinally through the casing assembly. There is a coupler 18 between a pair of packers 15 at each level of the bore hole where it is desired to take samples or measurements. The number of these depend upons the depth of the bore hole and the number of levels at which these samples or measurements are to be taken. The length of each casing 20 and its bag 15 depends upon the location of the different levels and the depth of the bore hole.

A probe or instrument 23 according to the present invention is moved up and down in passageway 22 of the casing assembly by means of a suitable cable 24 connected to the upper end thereof.

In this example, the casing 20 of each packer 15 extends through and is substantially concentric with an expandable cylindrical packer tube, membrane or bag 25 formed of suitable elastic material, such as natural or synthetic rubber or plastic such as urethane. Urethane is preferred because of its stretching and abrasion-resistant characteristics. The membrane is clamped at opposite ends to casing 20 by circular fasteners or clamps 28. The ends of casing 20 project beyond the ends of the packer tube 25.

A port 29 in casing 20 within the tube or bag 25 may under some circumstances be left open, but normally is closed by check valve 30. In this example, valve 30 is in the form of a wide elastic band extending around the casing and over port 29. After the casing assembly 11 been inserted in well 10 the packer tubes or bags 25 of packers 15 are inflated or expanded by directing a fluid, such as air or water, into the respective bags through the valve-controlled ports thereof. The valves 30 will open under internal pressure to permit fluid to flow into the packer tubes and close when the internal pressure is released and when they are subjected to external pressure greater than the internal pressure. If desired, bags 25 may contain a material, such as cement or grout, which hardens or sets when water or other suitable liquid is directed into the bags. Bags 25 may also be filled with a settable cement, grout or gel directed thereinto through ports 29.

Figure 3:
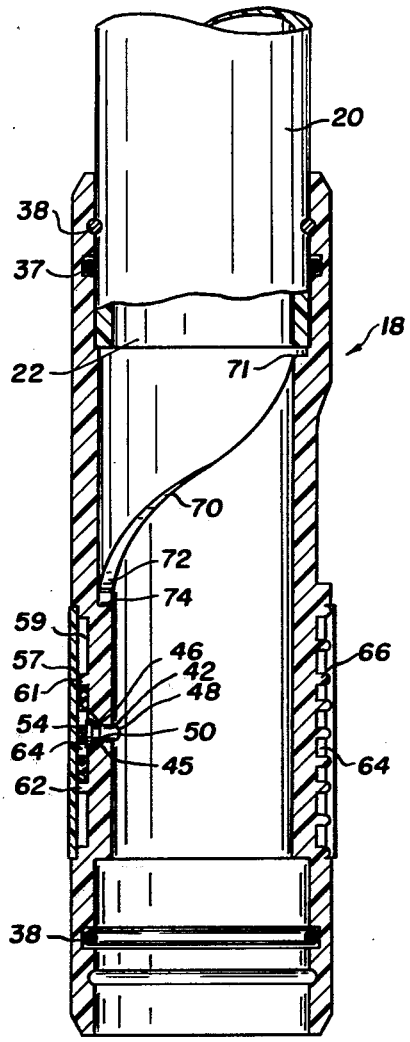
FIG. 3 is an enlarged fragmentary sectional view through a coupler of the casing assembly shown at right angles to the couplers of FIG. 2, FIG. 4 diagrammatically illustrates one form of probe in a casing assembly at a sample-taking or measurement level.

The coupler 18 may be in any desired form, and the illustrated coupler is in the form of a tube 35 formed of plastic, metal or the like, see FIG. 3. The ends of axially aligned casings 20 fit into the ends of the coupler tube, and suitable sealing and connecting means are provided between these elements, such as sealing rings 37 and connecting rings 38.

A measuring port 42 is formed in the wall of coupler tube 35 spaced from the ends of the tube. This port is normally closed by a suitable valve which can be opened from within the tube. In this example, a valve 45 having a seal in the form of an O-ring 46 is seated in port 42 and has a stem 48 extending through the port and slightly into the bore of the tube. This stem preferably has a rounded inner end 50. Valve 45 is normally maintained in its closed position by an elastic pad 54 which presses against the valve to retain the latter seated in and closing port 42. This pad is retained in position in any desired manner, such as by a wide band or sleeve 57. This band fits in a relatively large annular groove 59 formed in and surrounding the outer surface of the coupler tube wall. Spaced ribs 61 and 62 projecting outwardly from the bottom of groove 59 support band 57 against external pressure, and form therebetween an annular passage 64 which extends around the tube 35. The band or sleeve 57 has a slot 66 therein diametrically opposite the port 42, see FIGS. 2 and 3. Fluids can enter passage 64 through the band slot 66, and when valve 45 opens port 42, these fluids can flow into the coupler.

Suitable stop means is provided on coupler tube 35 so positioned relative to measuring port 42 as to stop probe 23 in the tube in correct operating position at the measuring port for taking measurement or samples through said port, or ejecting fluid through the port. In coupler 18, this stop means comprises a pair of helical shoulders 70 on the inner surface of the wall of tube 35 and curving away from each other at adjacent outer ends 71 inwardly of the tube and back to adjacent inner ends 72 on the opposite side of the tube spaced from the ends thereof. A stop surface 74 is formed on the inner surface of the coupler tube at the inner ends of the helical shoulders 70. This stop surface 74 is located a predetermined distance from the measuring port 42.

FIGS. 4 to 7 illustrate one form of probe 23 in accordance with this invention. The probe includes a cylindrical housing 80, which is of suitably smaller diameter than the inner diameter of passage 22 in the casing assembly. The length of housing 80 depends upon the types of samplings and measurements to be taken at each level, and the number of these taken at a given time.

The probe housing 80 has a bearing surface 82 which protrudes a little laterally from the housing. This surface is shaped to fit into the curve of the inner surface of coupler tube 35. A port 85 opens out centrally of the bearing surface 82, and suitable sealing means is provided for isolating this port from the interior of the casing assembly. In this example, a resilient ring seal 87 is mounted in the bearing surface and protrudes therefrom and surrounds the port.

On the opposite side of the probe housing 80 from bearing surface 82 is an operating plate or backing shoe 90 which is normally rectracted, but which can be moved a limited distance outwardly in the radial direction. Shoe 90 is connected to parallel upper and lower guide pins 91 and 92 slidably mounted in the housing.

The probe housing has an outwardly and downwardly extending stop or locating arm 93 radiating therefrom. Although this arm may be fixed, it is preferably retractable into the casing. Furthermore, the stop arm is preferably depressible when the probe is moving upwardly, but not when the probe moves downwardly.

Figure 4:
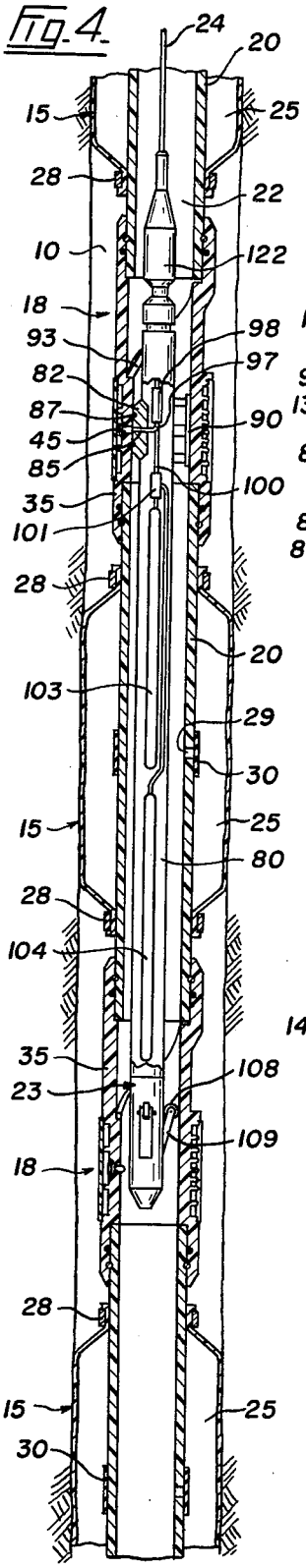

The probe 23 contains whatever mechanisms are necessary to measure temperature, pressure, and the like, and to take samples of gas, liquid or particulate material, or to eject fluids. The probe can include an electrically driven pump (not shown) for drawing fluids into the probe and/or ejecting fluids therefrom. FIG. 4 shows a tube 97 extending from port 85 to a suitable sensor 98, and another tube 100 extending from the sensor to a selective valve 101 which is connected to elongate containers 103 and 104. With this arrangement, samples of fluids can be drawn through port 85 respectively into containers 103 and 104 at different times.

The probe housing 80 may be provided with guide rollers 108 carried by arms 109 inclined outwardly from the housing, these arms being resiliently urged outwardly against the inner surface of passageway 22 of the casing assembly normally to keep the probe away from the wall of the passageway.

Figure 5:
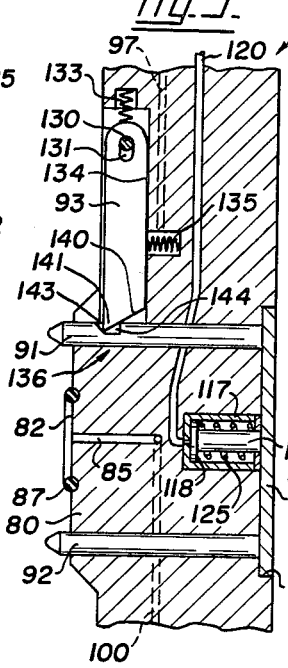
FIG. 5 is an enlarged vertical section through a portion of the probe showing a locating arm thereof in its normal inoperative position.
Figure 6:
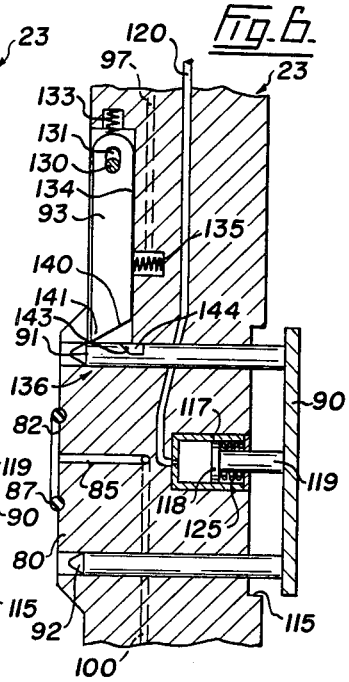
FIG. 6 is a view similar to FIG. 5 showing the locating arm just prior to movement into operative position.
Figure 7:
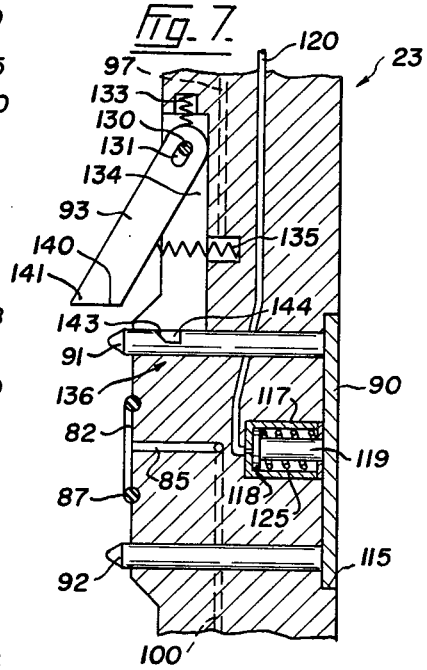
FIG. 7 is a view similar to FIG. 6 showing the locating arm in the operative position.

FIGS. 5, 6 and 7 illustrate one arrangement for operating the backing shoe 90 and the stop or locating arm 93. The backing shoe is in the form of a transversely curved plate slidably fitting in a recess 115 formed in the probe housing 80 diametrically opposite the bearing surface 82 thereof. A cylinder 117 is fixedly mounted in housing 80 behind the shoe 90 and has a piston 118 therein connected to the shoe by a piston rod 119. Fluid is directed into and out of the inner end of cylinder 117 through a tube 120 which, in this example, extends upwardly to a suitable connector 122 which is releasably connected to the upper end of the probe housing and is carried by the lower end of cable 24. The cable includes suitable tubular means for directing fluid to and from the tube 120 through suitable tubular means in connector 122.

When the fluid is directed into cylinder 117, piston 118 moves the shoe 90 outwardly against the inner surface of coupler tube 35, and this shifts the probe laterally unitl the sealing ring 87 of bearing surface 82 is pressed against the inner surface of the coupler tube around sampling port 85. When the pressure of the operating fluid in tube 120 is released, the shoe 90 is retracted by a spring 125 which surrounds piston rod 119 between piston 118 and the outer end of cylinder 117.

Stop or locating arm 93 is pivotally mounted at its upper end on a pin 130, said pin extending through an elongated slot 131 formed in the arm. This arm normally hangs down in a longitudinal slot 134 formed in the probe housing 80. Arm 93 is resiliently urged downwardly by a spring 133 at its upper end, and it is biased outwardly by another spring 135 which bears against the arm spaced downwardly from pin 130. A latch pin normally retains the lower end of arm 93 within slot 134 of the probe housing. In this example, pin 91 also acts as a latch pin for this purpose. The latch pin 91 is fixed at one end to shoe 90 and extends horizontally past the lower end of the locating arm 93. The lower end of the arm is formed with an inclined surface 140 which, in turn, forms a tip 141 on the arm which normally fits against an inclined surface 143 of a recess 144 formed in latch pin 91. The tip 141 normally bears against the inclined surface 143 of recess 144, and this surface maintains arm 93 in its retracted position.

It is preferable that pins 91 and 92 are long enough to project laterally from bearing surface 82 sufficiently to protect ring seal 87 when the probe is moved through the casing assembly.

When the backing shoe 90 is moved outwardly by piston 118, the latch pin 91 moves with it, at which time the tip 141 of the locating arm 93 slides up the bevelled or inclined surface 143 of recess 144 onto the upper surface of the latch pin, as shown in FIG. 6, the elongate slot 131 of the arm allowing this vertical movement to take place. When the backing shoe moves back into the probe housing, pin 91 swings the lower end of locating arm 93 outwardly until spring 135 can bias the arm to its outer position.

When it is desired to take a sample or measurement at a given level in casing assembly 11, probe 23 is lowered in passageway 22 through the casing assembly 11 until it is below the coupler 18 at the desired level. Locating arm 93 is latched in its retracted position at this time. Then fluid is directed through tube 120 to cause the backing shoe 90 to be moved outwardly, following which said shoe is retracted. This action releases the locating arm so that it swings outwardly into its operative position, as shown in FIG. 7. The probe is now drawn upwardly until it is above the adjacent coupler 18. As the locating arm 93 is resiliently urged outwardly, it cannot open valve 45 even if it does contact the stem 48 thereof. Following this, the probe is lowered in the casing assembly, and regardless of which way the locating arm 93 is facing in the casing assembly at this time, the arm will engage one of the helical shoulders 70 which will direct the arm downwardly on to stop surface 74. This action positions probe port 85 in line with the port 42 of the adjacent coupler 18. The backing plate 90 is now extended outwardly from the probe casing, and this shifts the probe laterally to place the ring seal 87 thereof against the inner surface of the coupler and around the coupling port 42 and the probe port 85. This outward movement of the shoe draws the ends of pins 91 and 92 into the probe so as to allow the ring seal to engage the inner surface of the casing. The locating arm 93 bearing against stop surface 74 assures the two ports being in registry at this time. This lateral shifting of the probe also causes the bearing surface 82 to depress stem 48 thereby opening valve 45. Samples can be obtained through connected tubes 85, 97 and 100, and measurements can be made through the same tubes. When the ring seal 87 is pressed against the inner surface of the coupler, the registering ports 42, 85 are isolated from the interior of the probe.

Figure 8:
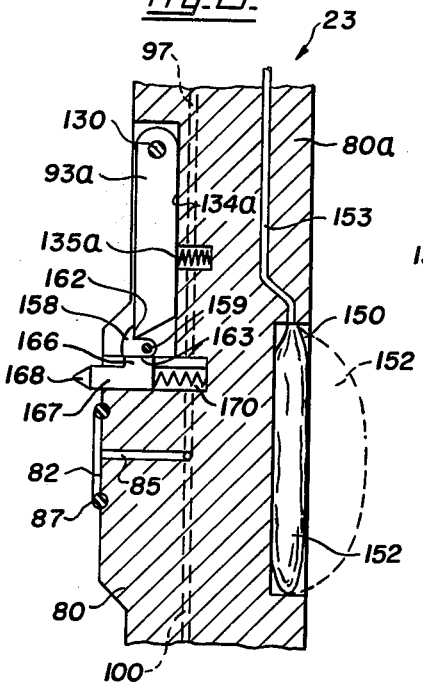
FIG. 8 is a view similar to FIG. 5 showing an alternative form of operating mechanism in the probe and with the locating arm in the normal inoperative position.
Figure 9:
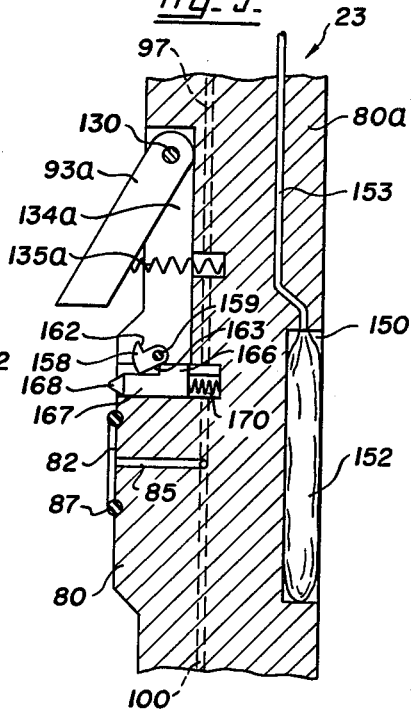
FIG. 9 is a view similar to FIG. 8 showing the locating arm in the operative position.

FIGS. 8 and 9 illustrate an alternative means for shifting probe 23 laterally when desired, and alternative means for latching the locating arm **93*a* in its retracted position. The arm 93*a* is similar to arm 93 described above, and is biased towards the outer position by a spring 135*a***.

In place of backing shoe 90, the probe housing **80*a* has a slot or recess 150 therein in which is located a bag 152. This slot or recess is diametrically opposite the probe port 85. This bag is normally deflated, and fluid is pumped into and out of it through a tube 153 which corresponds to tube 120 described above. When the bag is inflated, a portion of it emerges from recess 150 in the probe housing and bears against the inner surface of coupler tube 35 to shift the probe laterally in the manner described above. When the bag is deflated, the probe hangs substantially centrally of passage 22** in the casing assembly.

An L-shaped latch 158 is swingably mounted on a pin 159 at the lower end of locating arm 93*a*. This latch has a vertical section 162 which normally overlaps the lower end of arm 93*a*, and a horizontal section 163 normally bearing against a raised shoulder 166 on a horizontal trigger pin 167 which has an outer end 168 normally projecting a little laterally from the probe housing and beyond seal ring 87. The trigger pin is biased into its outer position by a spring 170 bearing against the inner end of the pin.

When trigger pin 167 is in its normal position, latch 158 is locked with its vertical section 162 retaining the locating arm 93*a* in its retracted position. However, when the shifting bag 152 is inflated and the probe is shifted laterally, the outer end 168 of trigger arm 167 engages the inner surface of the coupler tube 35 so that the trigger pin is pressed into the probe housing 80. This shifts the pin shoulder 166 inwardly past pin 159 to allow the latch 158 to swing downwardly, as shown in FIG. 9, and this allows the biasing spring 135*a* to swing the locating arm 93*a* outwardly into its operative position.

When the probe of FIGS. 8 and 9 is to be used to take a sample or measurement at a given level, the probe is lowered below the coupling at that level and then bag 152 is inflated to shift the probe laterally. This causes trigger pin 167 to be depressed to allow latch 158 to release the locating arm 93*a* to permit said arm to swing into its operative position. The bag 152 is now deflated, following which the probe is moved to a position just above the coupler at the desired level. When the probe is lowered again, the locating arm 93*a* is guided onto stop surface 74 of the coupler, after which the bag 152 is inflated to shift the ring seal 87 against the coupler surface around the registering ports 45 and 85 thereby isolating said ports. This movement of the probe also depresses stem 48 to open valve 48. Samples can now be obtained through connected tubes 85, 97 and 100, and measurements can be made through these same tubes.

With both of the examples described above, the latch arm 93 or 93*a* is reset into its retracted position after the probe 23 has been drawn up to the surface.

The necessary control wires and tubes form part of cable 24 as is standard practice. In addition, the connections of these wires and tubes to corresponding wires and tubes in probe 23 are made in connector 122 also in accordance with standard practice.

We claim:

1. A probe for use in casing assemblies having ports therein at different levels through which samples and/or measurements can be taken from the environment around the casing at said ports, said probe comprising an elongate body having an upper end to be connected to suspension means through which fluids and data and operating power can flow to and from the body, a port in the body, stop means on the body to co-operate with stop means on the casing assembly in which the probe operates at each level to stop the probe with the body port in registry with the casing assembly port at said each level, sealing means at the body port to isolate said body port from the interior of the casing assembly when the body port is in registry with a casing port, and pressure means selectively operable to press said sealing means into engagement with the casing when said ports are in registry, whereby samples and/or measurements can be selectively taken from outside the casing assembly and through the registering ports within contamination or interference by conditions at any other of said casing assembly ports.

2. A probe as claimed in claim 1 in which said stop means comprises a locating arm mounted in the body for movement into and out of the latter, means normally retaining the locating arm in the body, and means for selectively moving the arm out of the body to engage a stop on the casing so positioned as to stop the probe with the port thereof in registry with an adjacent port of the casing assembly.

3. A probe as claimed in claim 1 in which said stop means comprises a locating arm swingably mounted at an upper end in the body, said arm being swingable between an inner position in the body and an outer position projecting outwardly and downwardly of the body, a latch normally retaining the arm in the inner position, operating means selectively operable to cause the latch to release the arm, and spring means biasing the released arm outwardly to engage a stop on the casing assembly so positioned as to stop the probe with the port thereof in registry with an adjacent port of the casing assembly.

4. A probe as claimed in claim 1 in which said selectively operable means comprises a backing shoe mounted on the body on the side thereof opposite the body port for movement outwardly relative to the body, and power means operable to move the shoe outwardly against the casing assembly to shift the body in the opposite direction and thereby press the sealing means against the casing assembly near the port thereof.

5. A probe as claimed in claim 1 in which said sealing means comprises a ring seal surrounding the body port and projecting outwardly from the body and said selectively operable means comprises a backing shoe mounted on the body on the side thereof opposite the body port for movement outwardly relative to the body, and power means operable to move the shoe outwardly against the casing assembly to shift the body in the opposite direction ahd thereby press the ring seal against the casing assembly around the body and casing assembly ports.

6. A probe as claimed in claim 1, in which said selectively operable means comprises an inflatable backing bag in the body on the side thereof opposite the body port, said bag normally being deflated and when inflated projecting from the body to engage the casing assembly and thereby move the body to press the sealing means thereof against the casing assembly near the port thereof, and means for directing operating fluid into and out of the backing bag.

7. A probe as claimed in claim 1 in which said sealing means comprises a sealing ring surrounding the body port and projecting outwardly from the body, and in which said selectively operable means comprises an inflatable backing bag in the body on the side thereof opposite the body port, said bag normally being deflated and when inflated projecting from the body to engage the casing and thereby move the body to press the sealing ring against the casing assembly around the body and casing assembly ports, and means for directing operating fluid into and out of the backing bag.

8. A probe as claimed in claim 1 in which said stop means comprises a locating arm swingably mounted at an upper end in the body, said arm being swingable between an inner position in the body to an outer position projecting outwardly and downwardly of the body, a latch normally retaining the arm in the inner position, a trigger slidably mounted in the body and having and outer end projecting laterally from the body, said trigger being movable between and outer position and an inner position, spring means normally biasing the trigger to the outer position, a shoulder on the trigger normally engaging the latch to retain the locating arm in its inner position, said shoulder freeing the latch when the trigger is moved to its inner position to allow the latch to release the arm, whereby said arm swings outwardly to engage a stop on the casing assembly so positioned as to stop the probe with the port thereof in registry with an adjacent port of the casing assembly, and in which said selectively operable means when operated moves the body laterally to cause the outer end of the trigger to engage the casing assembly whereby the trigger is moved to its inner position.

9. A probe as claimed in claim 8 in which said pressure means comprises an inflatable backing bag in the body on the side thereof opposite the body port, said bag normally being deflated and when inflated projecting from the body to engage the casing assembly and thereby move the body to press the sealing means against the casing assembly near the port thereof, and means for directing operating fluid into and out of the backing bag.

10. A probe as claimed in claim 8 in which said sealing means comprises a sealing ring surrounding the body port and projecting outwardly from the body, and in which said selectively operable means comprises an inflatable backing bag in the body on the side thereof opposite the body port, said bag normally being deflated when inflated projecting from the body to engage the casing assembly and thereby move the body to press the sealing ring against the casing assembly around the body and casing ports, and means for directing operating fluid into and out of the backing bag.

11. A probe for use in casing assemblies having ports therein at different levels through which samples and/or measurements can be taken from the environment around the casing at said ports, said probe comprising an elongate body having an upper end to be connected to suspension means through which fluids and data and operating power can flow to and from the body, a port in the body, sealing means on the body around said port, a locating arm swingably mounted near an end in the body, said arm being swingable between an inner position in the body and an outer position projecting outwardly and downwardly of the body, a latch normally retaining the arm in the inner position, spring means to bias the arm outwardly when said arm is released, a shoe mounted on the body on the side thereof opposite the body port for movement outwardly and inwardly relative to the body, means normally biasing the shoe inwardly relative to the body, means connecting the latch to the shoe to cause the latch to move with the shoe and thereby release the locating arm, and power means selectively operable to move the shoe outwardly of the body, whereby a first operation of the power means causes movement of the shoe to release the location arm to engage a stop on the casing assembly so positioned as to stop the probe with the port thereof in registry with an adjacent port of the casing assembly, and a second operation of the power means moves the shoe outwardly of the body against the casing assembly to shift said body in the opposite direction and thereby press the sealing means against the casing assembly near the port thereof to isolate said port from the interior of the casing assembly.

12. A probe for use in casing assemblies having ports therein at different levels through which samples and/or measurements can be taken from the environment around the casing at said ports, and a valve normally closing each of said ports operable from within the assembly, said probe comprising an elongate body having an upper end to be connected to suspension means through which fluids and data and operating power can flow to and from the body, a port in the body, stop means on the body to co-operate with stop means on the casing assembly in which the probe operates at each level to stop the probe with the body port in registry with a casing port, a backing shoe mounted on the body on the side thereof opposite the body port for movement outwardly relative to the body, and power means operable to move the shoe outwardly against the casing assembly to shift the body in the opposite direction to thereby press the sealing means against the casing assembly near the port thereof and to open the valve of said latter port.

13. A probe as claimed in claim 12 in which the valve of each casing assembly port has a stem projecting slightly into the interior of the casing assembly, and movement of the body in said opposite direction causes said body to engage the stem of the adjacent valve to open said valve.

* * * * *